US006932071B2

(12) United States Patent
Gallops, Jr.

(10) Patent No.: US 6,932,071 B2
(45) Date of Patent: Aug. 23, 2005

(54) METHOD FOR MANUFACTURING RIBBED ARCHERY BOW LIMB PORTIONS AND THE RIBBED ARCHERY BOW LIMB PORTIONS PRODUCED THEREBY

(75) Inventor: Henry M. Gallops, Jr., Gainesville, FL (US)

(73) Assignee: SOP Services, Inc., Las Vegas, NV (US)

( * ) Notice: Subject to any disclaimer, the term of this patent is extended or adjusted under 35 U.S.C. 154(b) by 0 days.

(21) Appl. No.: 10/748,021

(22) Filed: Dec. 30, 2003

(65) Prior Publication Data

US 2005/0139199 A1 Jun. 30, 2005

(51) Int. Cl.[7] ..... F41B 5/00; F41B 5/10
(52) U.S. Cl. ..... 124/23.1; 124/25.6
(58) Field of Search ..... 124/23.1, 25.6

(56) References Cited

U.S. PATENT DOCUMENTS

| | | | | |
|---|---|---|---|---|
| 1,877,273 A | * | 9/1932 | Cowdery | 124/23.1 |
| 3,850,156 A | | 11/1974 | Eicholtz | |
| 3,965,883 A | | 6/1976 | Meyer | |
| 4,669,445 A | * | 6/1987 | Schaar | 124/25.6 |
| 4,671,249 A | * | 6/1987 | Troncoso | 124/23.1 |
| 5,433,792 A | | 7/1995 | Darlington | |
| 5,501,208 A | | 3/1996 | Simonds | |
| 5,534,213 A | | 7/1996 | Epling | |
| 5,718,212 A | | 2/1998 | Allshouse et al. | |
| 5,845,388 A | | 12/1998 | Andrews et al. | |
| 6,067,974 A | | 5/2000 | Islas | |
| 6,105,564 A | | 8/2000 | Suppan | |
| 6,142,132 A | | 11/2000 | Simonds | |
| 6,499,478 B1 | * | 12/2002 | Perez | 124/86 |
| 6,588,411 B1 | | 7/2003 | Simonds | |

FOREIGN PATENT DOCUMENTS

| | | |
|---|---|---|
| EP | 0 246 891 | 11/1987 |
| WO | WO 87/02444 | 4/1987 |

* cited by examiner

*Primary Examiner*—John A. Ricci
(74) *Attorney, Agent, or Firm*—Woodard, Emhardt, Moriarty, McNett & Henry LLP

(57) ABSTRACT

Typically a limb for an archery bow has a butt section or end attachable to a bow riser, a middle or hinge section and an opposing tip section or end. In a preferred embodiment, the present method and limb includes a rib section formed in the middle or hinge portion of the limb. This allows a narrowed front-profile to be presented in the hinge section, while maintaining the total cross-sectional area. In one preferred method, at least one half of a mold is formed to define a rib section in the hinge section of the limb. Preferably the rib section runs longitudinally along the length of the hinge section, and may include a tapered profile along the edges and ends of the rib.

22 Claims, 9 Drawing Sheets

METHOD FOR MANUFACTURING RIBBED ARCHERY BOW LIMB PORTIONS AND THE RIBBED ARCHERY BOW LIMB PORTIONS PRODUCED THEREBY

FIELD OF THE INVENTION

The present invention relates generally to archery bows and more particularly pertains to an improved compression molded archery bow limb for use in bows and a method for manufacturing the same.

BACKGROUND OF THE INVENTION

Archery bow limbs perform the important function of storing energy when the archer draws the bowstring. When the bowstring is drawn, the pre-stressed bow limbs, which are typically made of resilient material, are further flexed to store additional energy. When the bowstring is released, the stored energy propels the arrow. In conventional compound bows, the limb is typically formed of a single element with a rectangular cross section, where one end is attached to the bow handle and the other end has a limb tip slot formed therein, in which a rotational member such as a wheel, cam or pulley is mounted.

Reinforced glass fiber materials have been utilized in archery bow limbs for a number of years. In some instances, the limb profile is machined from extruded solid glass fiber billets, and in other instances the limb profile is machined from pre-formed compression molded billets, which in some cases may be pre-formed to such near net shape that only secondary machining operations are required to remove excess material from the limb tip area and from the butt slot area, where the limb is joined to the handle. In all such cases, the secondary machining operations are costly and time consuming. Further, the machining operations result in the severing of load bearing fibers which reduces the maximum limb operating stress level and the fatigue life of the limbs.

There is a need for improved bow limbs.

SUMMARY OF THE INVENTION

In preferred embodiments, the present invention is concerned with a method for manufacturing continuous compression molded ribbed archery bow limb portions and the ribbed archery bow limbs produced thereby.

A method according to the present invention forms a limb for use in an archery bow. A preferred method comprises inserting a moldable slug having a plurality of longitudinally oriented resin impregnated fiber filaments into a limb portion profiling mold. The mold consists of two halves, a first half containing one or more female cavities and a second half having one or more mating male sections. Preferably, the first half is profiled to provide the configuration of the front of the limb portion, and the second half is profiled to provide the configuration of the rear of the limb portion. Each cavity receives a pre-determined volume and weight of continuous longitudinal fibrous reinforcement material, such as fiberglass and plastic resin matrix material. Heat and pressure are applied for initial curing. The limb is then removed from the mold, flashed and post-cured.

Typically a limb has a butt section or end attachable to a bow riser, a middle or hinge section and an opposing tip section or end. Preferably, the glass-to-resin ratio is substantially constant throughout the limb during forming. Typically this requires a substantially constant cross-sectional total area in the butt, hinge and tip sections. In a preferred embodiment, the present method and limb includes a longitudinal protruding rib section formed in the middle or hinge portion of the limb. This allows a narrowed front-profile to be presented in the hinge section, while maintaining the total cross-sectional area.

In one preferred method, at least one half of the mold, preferably the female cavity section, is formed to define a rib section in the hinge section of the limb. A limb formed with the mold integrally includes the rib section. Preferably the rib section runs longitudinally along the length of the hinge section, and may include a tapered profile along the edges and ends of the rib. As examples, the rib portion profile can be elliptical or rectangular.

It is an object of this invention to provide an improved method of manufacturing compression molded archery bow limb portions, and to provide improved archery bow limb portions.

Other objects and attendant advantages of this invention will be readily appreciated as the same become more clearly understood by references to the following detailed description when considered in connection with the accompanying drawings in which like reference numerals designate like parts throughout the figures thereof.

DETAILED DESCRIPTION OF PREFERRED EMBODIMENTS

For the purposes of promoting an understanding of the principles of the invention, reference will now be made to the embodiments illustrated and specific language will be used to describe the same. It will nevertheless be understood that no limitation of the scope of the invention is thereby intended, such alterations, modifications, and further applications of the principles of the invention being contemplated as would normally occur to one skilled in the art to which the invention relates.

A method according to the present invention forms a limb for use in an archery bow. A preferred method comprises inserting a moldable slug having a plurality of longitudinally oriented resin impregnated fiber filaments into a limb portion profiling mold. The mold consists of two halves, a first half containing one or more female cavities and a second half having one or more mating male sections. Preferably, the first half is profiled to provide the configuration of the front of the limb portion, and the second half is profiled to provide the configuration of the rear of the limb portion. Each cavity receives a pre-determined volume and weight of continuous longitudinal fibrous reinforcement material, such as fiberglass and plastic resin matrix material. Heat and pressure are applied for initial curing. The limb is then removed from the mold, flashed and post-cured.

Figure 1:
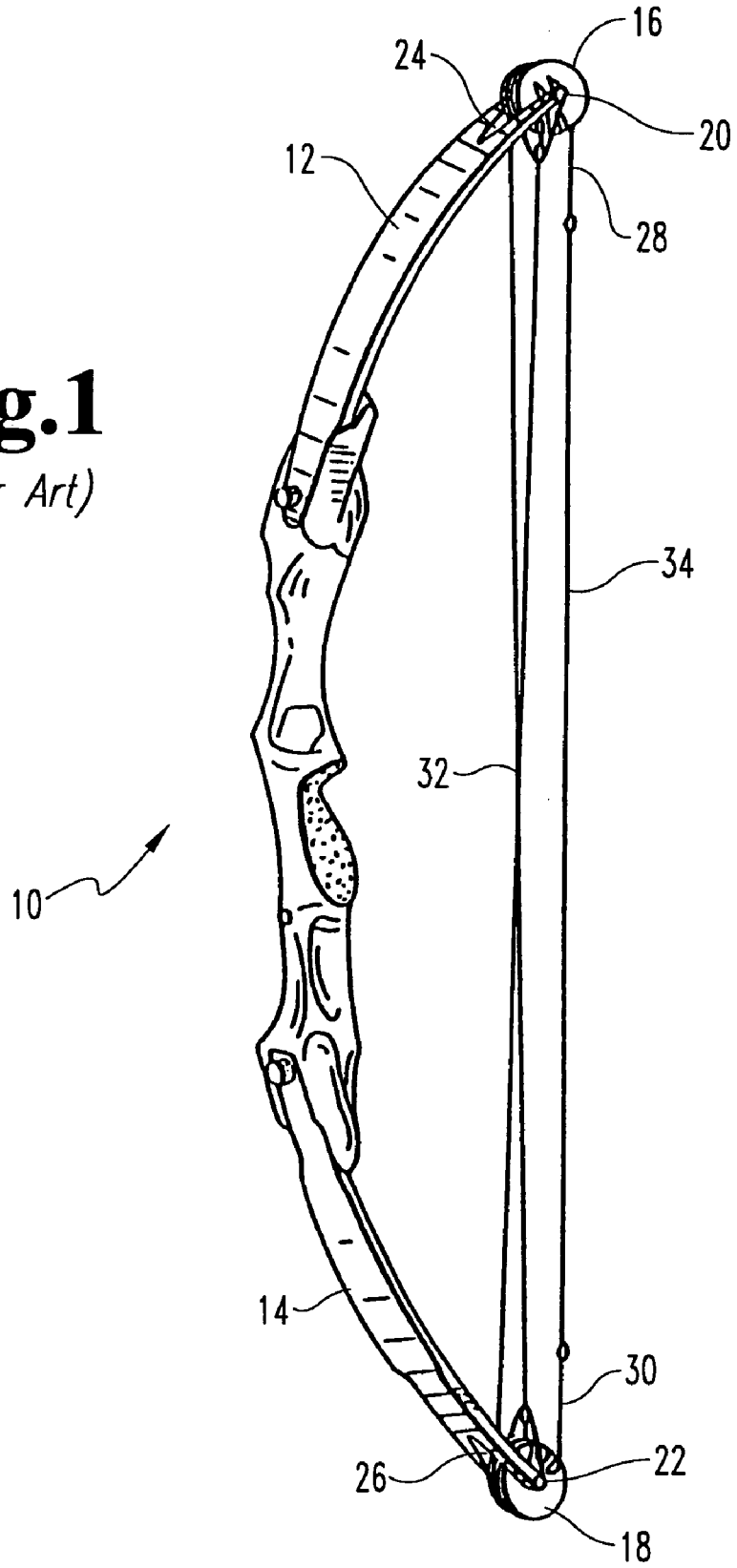
Fig.1 (Prior Art)
FIG. 1 is a perspective view of a prior art compound archery bow.

FIG. 1 illustrates one example of a conventional dual-cam compound archery bow generally designated as 10. When viewed from the perspective of an archer holding the bow 10, it includes a handle with an upper limb portion 12 and a lower limb portion 14. Centrally disposed rotational members forming variable leverage units such as eccentric pulleys 16 and 18 are supported at the limb tip sections for rotary movement about axles 20 and 22. In the embodiment shown, the upper pulley axle 20 is carried in a slot between the outer limb tip portions 24 of upper limb 12. The lower pulley axle 22 is carried in a slot between the outer limb tip portions 26 of lower limb 14.

Bowstring 34 includes upper end 28 and lower end 30 which are fed-out from pulleys 16 and 18 when the bow is drawn. Bowstring 34 is mounted around pulleys 16 and 18 as is known in the art. Anchor cable 32 preferably extends from an eccentric pulley on one limb, for example axle 20, to the extremities of the opposing bow limb, for example axle 22. The opposed upper bow limb 12 and lower bow limb 14 are relatively short and will characteristically have high spring rates.

When the bowstring 34 is drawn, it causes eccentric pulleys 16 and 18 at each end of the bow to rotate, feeding out cable and bending limb portions 12 and 14 inward, causing additional energy to be stored therein. When the bowstring 34 is released with an arrow engaged to the bowstring, the limb portions 12 and 14 return to their rest position, causing the eccentric pulleys 16 and 18 to rotate in the opposite direction, to take up the bowstring 34 and launch the arrow with an amount of energy proportional to the energy initially stored in the bow limbs. Bow 10 is described for illustration and context and is not intended to be limiting. The present invention can be used with dual-cam compound bows, or can be used with single-cam bows as described for example in U.S. Pat. No. 5,368,006 to McPherson, hereby incorporated herein by reference. The present invention can also be used in other types of bows, which are considered conventional for purposes of the present invention.

Figure 2:
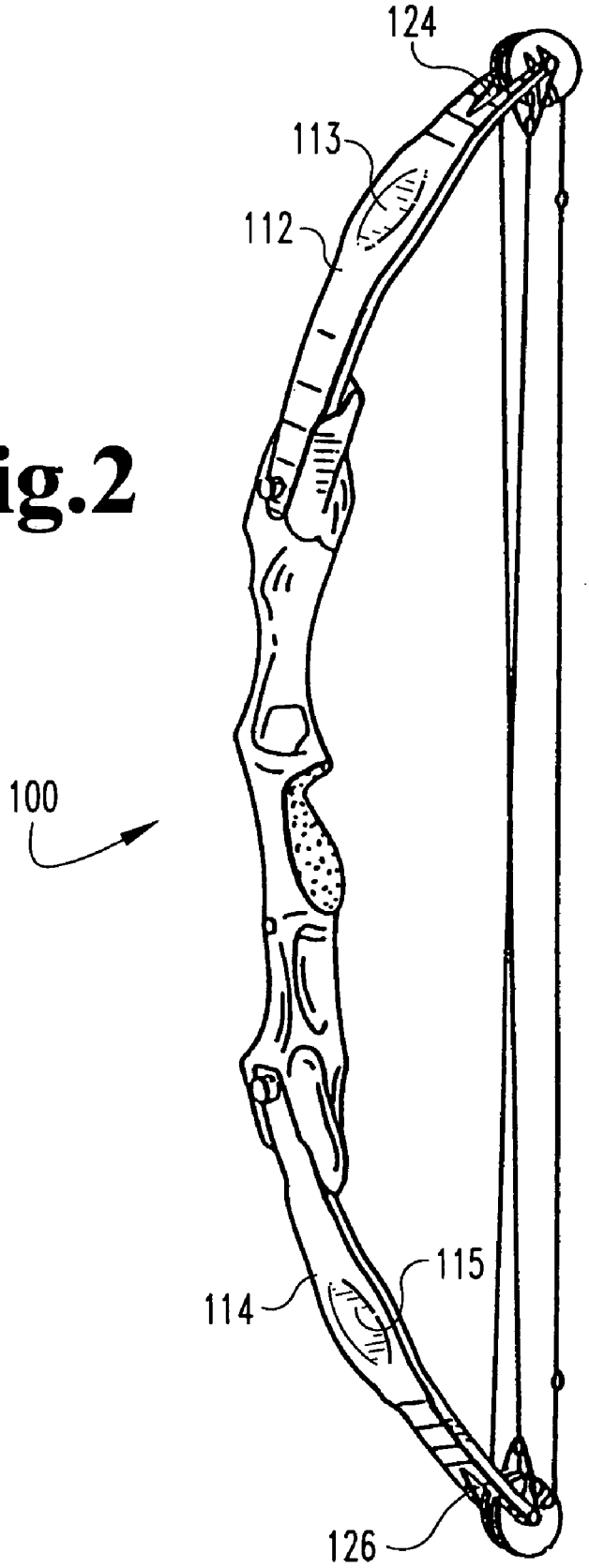
FIG. 2 is a perspective view of a compound bow according to one preferred embodiment of the present invention.

FIG. 2 illustrates a preferred embodiment of the present invention with, for example, bow 100 which is similar in operation to bow 10. Bow 100 includes a handle or riser with two limbs 112 and 114 extending therefrom. Limb portions 112 and 114 include slots 124 and 126 to receive pulleys or cams. Limbs 112 and 114 preferably include ribs 113 and 115. The pulleys and cabling of bow 100 are conventional.

Figure 3:
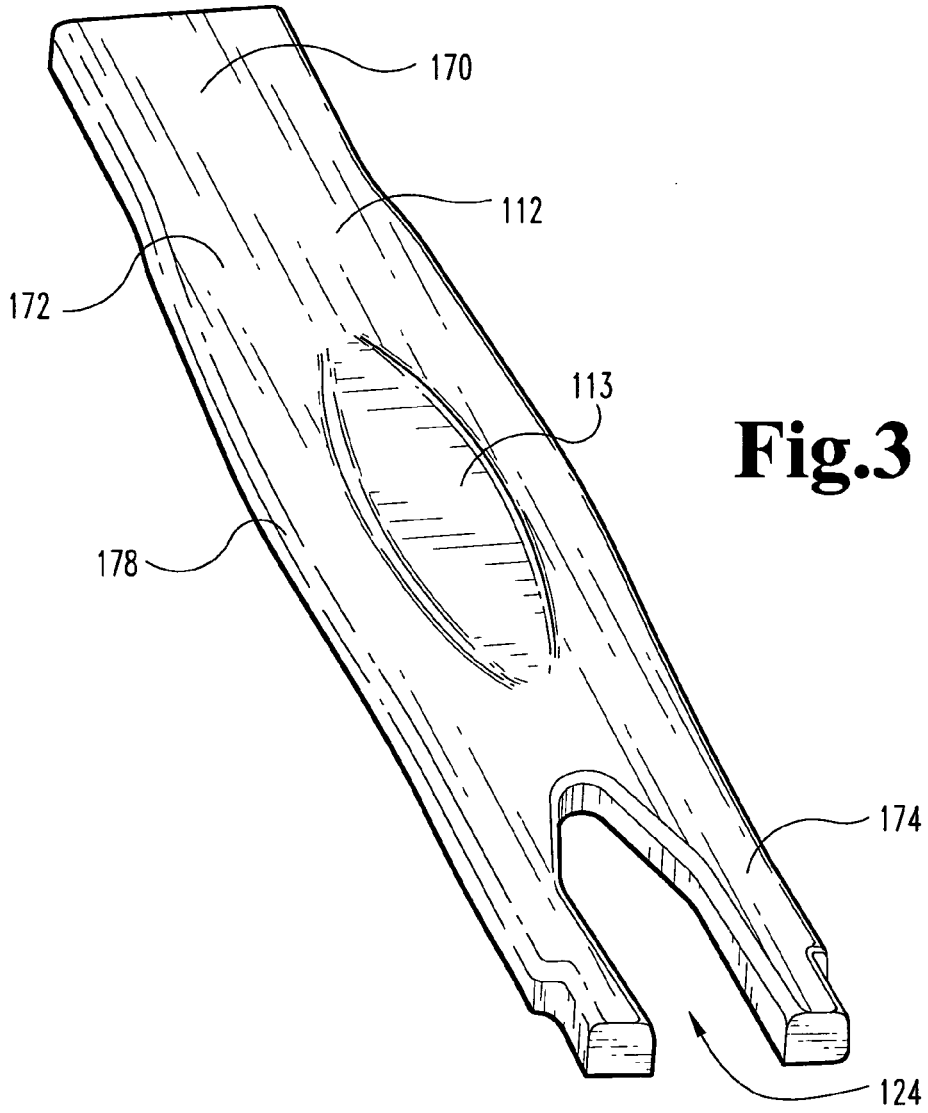
FIG. 3 is a perspective view of a bow limb according to one preferred embodiment of the present invention.

Illustrated in FIG. 3 is a perspective view of limb portion 112 with rib 113 according to one preferred embodiment of the invention. Limb portion 114 is symmetric to limb portion 112, and, although included in the present invention, will not be described in duplicate detail.

Figure 4:
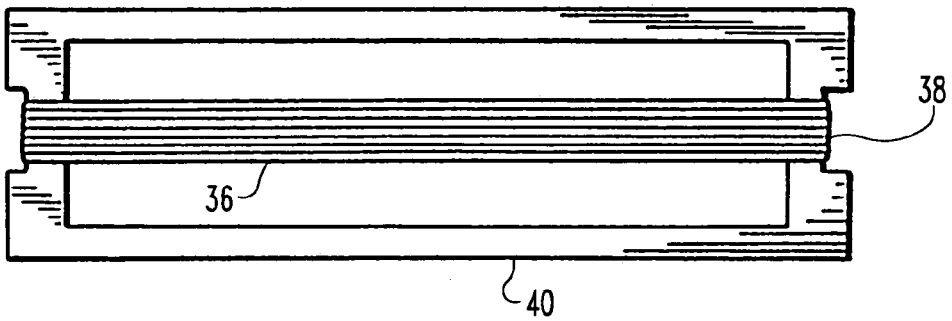
FIG. 4 is a top view of a slug frame with impregnated filaments wrapped thereon.

Referring to FIG. 4, there is illustrated, for example, a glass fiber slug 36 from which a bow limb portion such as portions 112 and 114 of the instant invention can be fabricated. Glass fiber filaments 38, which form the glass fiber slug 36, are initially drawn through a wet out tank containing a suitable resin. After absorbing the desirable amount of resin, the glass fiber filaments 38 are wrapped around frame 40. Each wrap consists of one complete turn or loop around a frame 40. A plurality of wraps are necessary to form each limb and therefore each slug 36 consists of a number of individual wraps.

Both the glass fiber and the resins used in this process are well known in the art. Suitable materials include glass fiber filaments which are packaged in spools and sold by Pittsburgh Plate Glass Corp. under the designation No. 712-218, to be employed with Shell 826 epoxy resin and a suitable heat activated catalyst such as Lindride 6K manufactured by Lindow Chemical Company. It has been found that the range of suitable glass fiber to resin ratios by weight is from 60% to 75% which is the equivalent of a glass fiber to resin ratio by volume in the range of 42% to 59%.

Figure 5A:
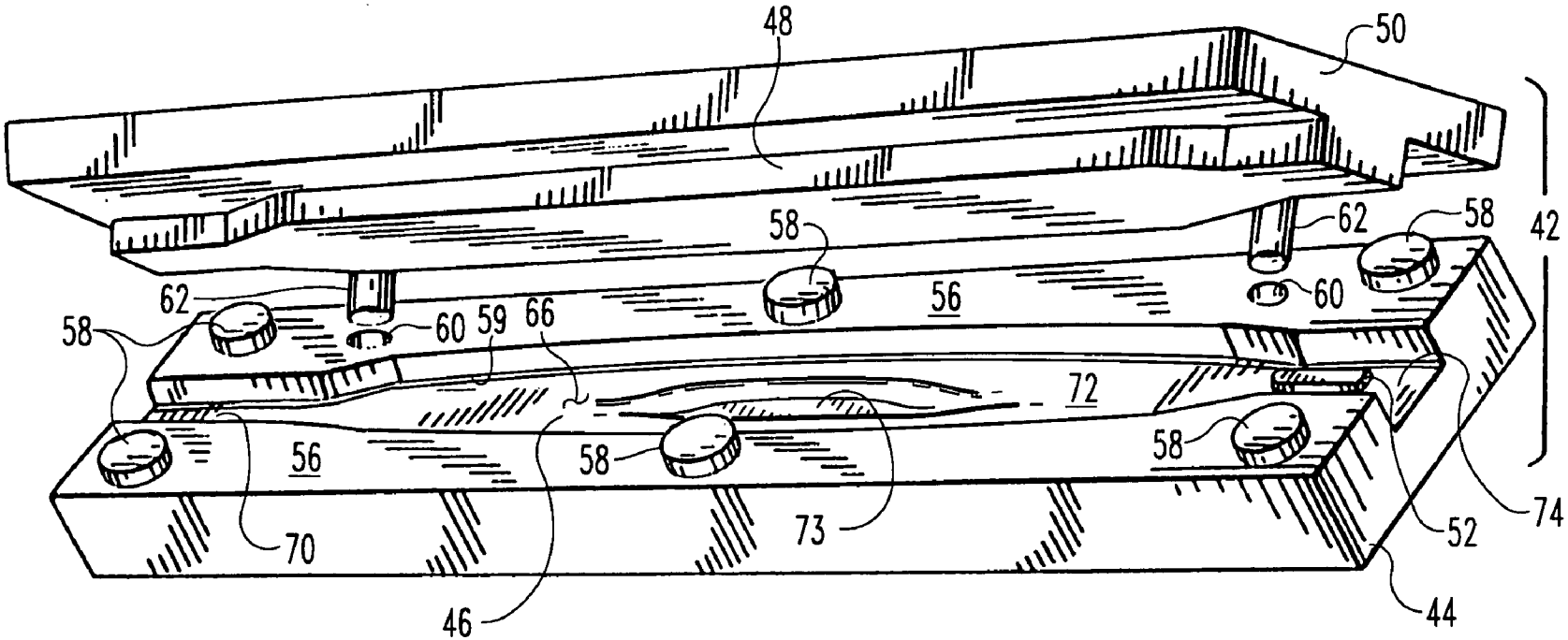
FIG. 5A is a perspective side elevation view of the mold assembly used in producing the bow limb portions of the present invention.
Figure 5B:
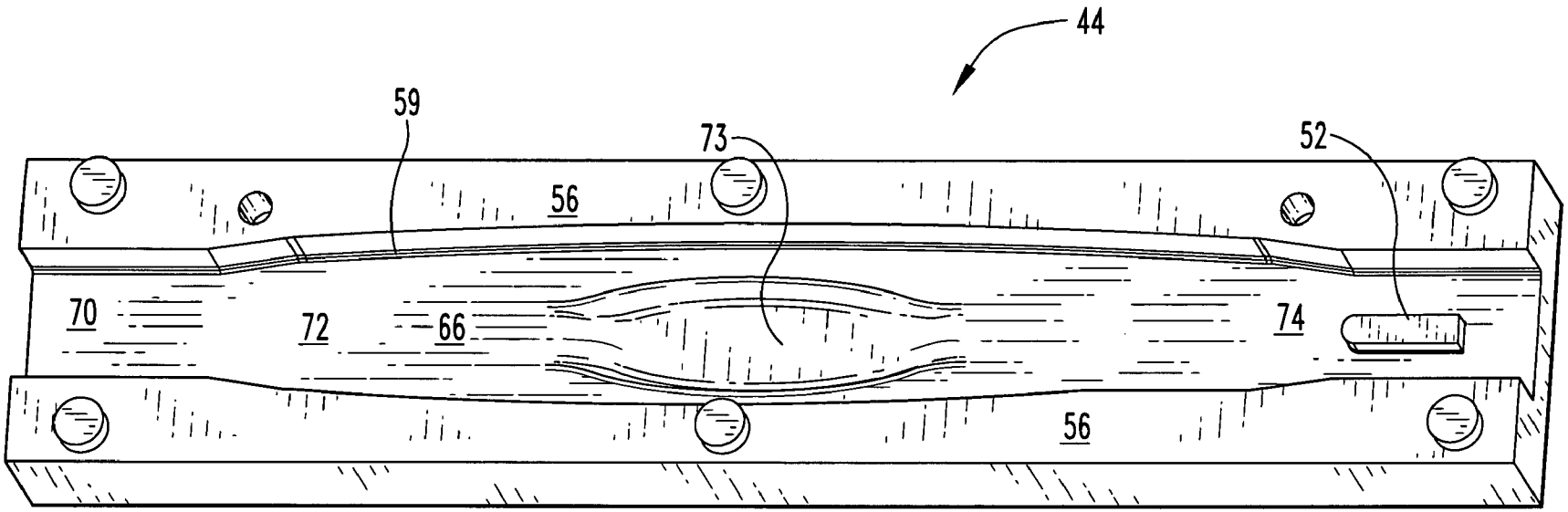
FIG. 5B is a perspective, top view of the lower mold.
Figure 6:
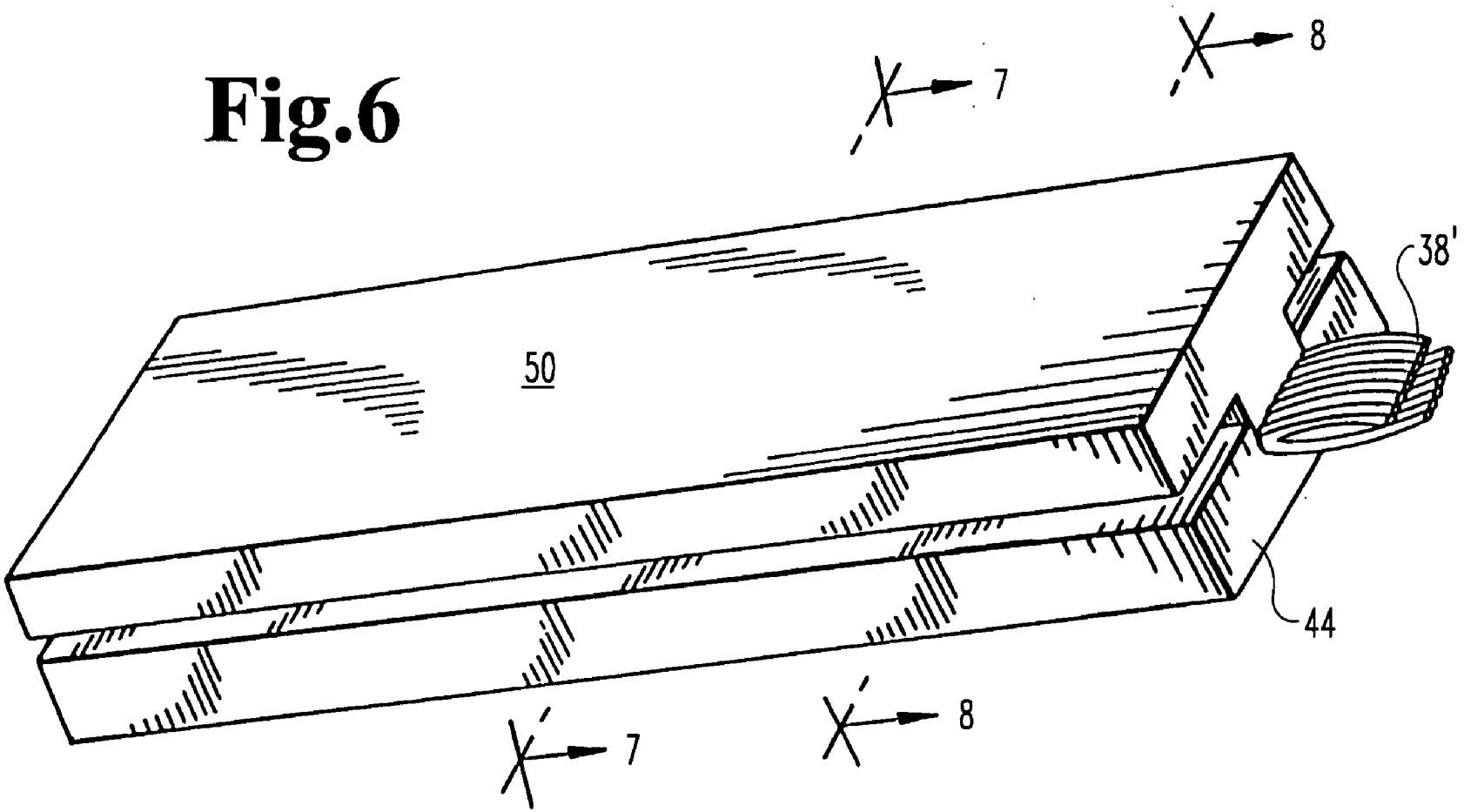
FIG. 6 is a perspective side elevation view of the mold assembly during curing.

When slug 36 is in suitable condition to be molded, it is inserted into the mold assembly 42 illustrated in FIGS. 5A and 5B. The frame 40 is positioned so that the slug 36 extends longitudinally within a female cavity 46 defined in lower mold 44 and the glass fiber filaments 38 extend out of the assembly 42 in the form of a tail 38' (see FIG. 6). Female cavity 46 is defined between sidewalls 56 and floor 66. Preferably, the female cavity 46 forms radiused lower corners 59. The cavity 46 of the lower mold 44 in conjunction with the mating male member 48 of upper mold 50 is shaped to form the slug 36 into a limb portion. Preferably the male member presses the slug into the cavity, and preferably the mold assembly 42 compresses the slug. In the embodiment shown, the floor 66 of female cavity 46 forms the front of the limb portion, while the face of male member 48 forms the rear of the limb portion. In a preferred feature, stops 58 limit the penetration of male mold member 48 into the female mold cavity 46, and openings 60 in lower mold 44 receive alignment pins 62 of upper mold 50 when the mold is closed.

Preferably the mold cavity defines a butt or base portion or end 70 for the limb, a middle or hinge portion 72 and tip portion or end 74. In one option (not shown), the mold defines a split area in the butt section to enable the limb to be attached to a bolt on a bow riser. In a further feature, the tip end 74 defines a partial height raised or split area 52 to form a reduced height limb tip portion which can be ground down to form slot 124 for a pulley to be mounted.

In one preferred embodiment of the present invention, at least one half of the mold, preferably the female cavity section 46, is formed with a rib cavity 73 to define a rib portion 113 in the hinge section 172 of the limb. A limb 112 formed with the mold integrally includes the rib portion 113. Preferably the rib portion 113 runs longitudinally along all or a portion of the length of the hinge section 172, and preferably includes a tapered profile at each end and along each edge of the rib. The rib profile may be substantially rectangular (FIGS. 10A–10B), substantially elliptical (FIG. 3), or in other generally longitudinal shapes and lengths. Preferably the rib profile is convex outward from the limb to an apex in the middle, and tapers downward into the limb material along the rib portion ends and sides.

In manufacturing the limb, the initial curing of the slug 36 occurs when slug 36 is inserted and compressed into the mold assembly 42 which has been heated to an operating temperature of approximately 300 degrees to 350 degrees Fahrenheit. Slug 36 is preferably maintained in the closed mold assembly 42 at this temperature for a period of 5 to 10 minutes, whereby slug 36 is set to assume the profile determined by the mold assembly 42. Slug 36 is then removed from the mold assembly 42 and the uncured glass fiber filaments forming the tail 38' are severed (see FIG. 6). The slug 36 is then cured by being placed in an oven at approximately 350 degrees Fahrenheit for a period of about three hours. Slot 124 is then machined into limb portion 112 for the purpose of receiving an axle pin and pulley.

In a preferred feature, front corner edges 178 of the formed limb 112 are molded with a radius along their length by a radiused corner profile 59 in lower mold 44. This is provided to avoid having to machine grind or cut stress-inducing sharp corners. By molding in this radius, the fiber filaments are uncut, continuous and protectively sealed in the typically stressed corner areas.

In certain preferred embodiments, the glass-to-resin ratio is constant throughout the limb. Typically this requires a constant cross-sectional total area in the butt 170, hinge 172 and tip 174 sections of limb 112 (FIG. 3). In a preferred embodiment, the present method and limb includes a rib section 113 formed in the front of the middle or hinge portion 172 of the limb as part of the cross-section. This allows a narrowed front-profile to be presented in the hinge section, while maintaining the total cross-sectional area.

Figure 7:
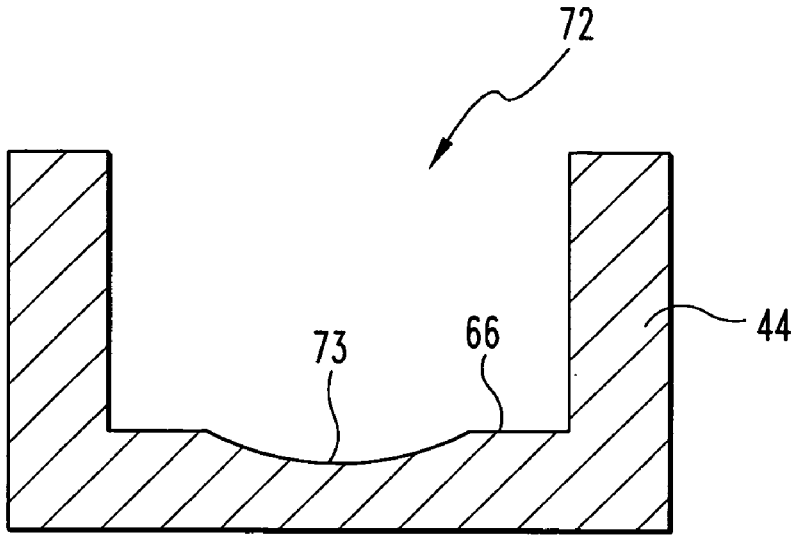
FIG. 7 is a cross-sectional view of the lower mold taken approximately along line 7—7 of FIG. 6 viewed in the direction of the arrows.
Figure 8:
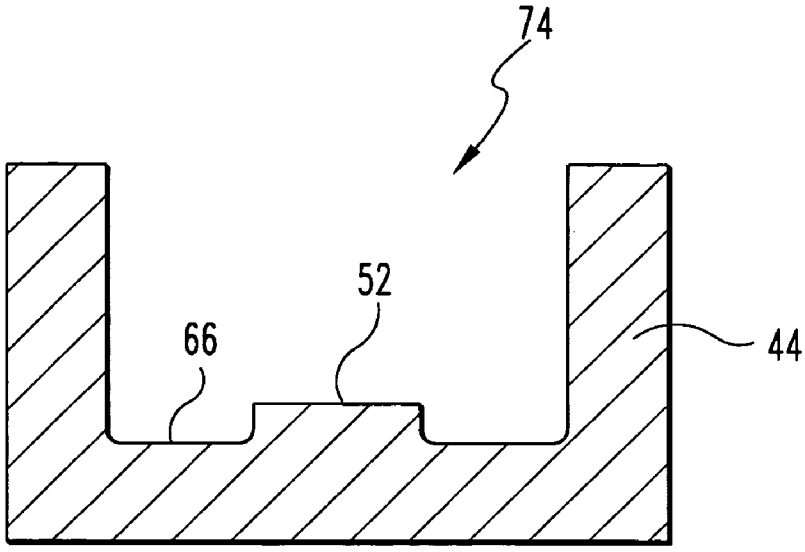
FIG. 8 is a cross-sectional view of the lower mold taken approximately along line 8—8 of FIG. 6 viewed in the direction of the arrows.

Preferably the cross-sections of the mold are formed in calculated dimensions to maintain a substantially constant cross-sectional area along the length of the mold and in resulting limbs. A cross-section of part of the mold's hinge portion 72 is shown in FIG. 7 and a cross-section of the mold's tip section 74 shown in FIG. 8.

Figure 9A:
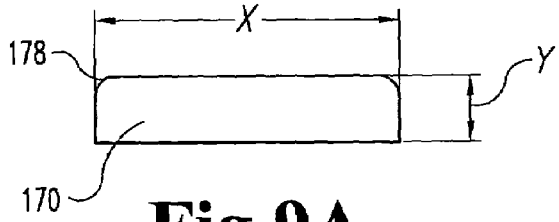
FIGS. 9A–9D are cross-sectional views of a bow limb of the present invention.

The geometric cross-sectional area of the limb is calculated by multiplying the width times the height, less the corner areas which are reduced by the corner radii portions, plus the cross-sectional area of the rib where included. Examples of limb 112 cross-sections are shown in FIGS. 9A–9D. In FIG. 9A, the cross-section of the limb butt section 170 is shown with width x and height y. The cross-sectional area A is generally x times y, minus a slight area lost due to radiused corner profiles 178. One formula for this could be $A=(x \text{ times } y)-(r^2-\frac{1}{4}\pi r^2)$ where r is the radius of a circular corner. The formulas below do not account for the corner profiles for the radius of a circular corner. The formulas below do not account for the corner profiles for case of illustration.

Figure 9B:
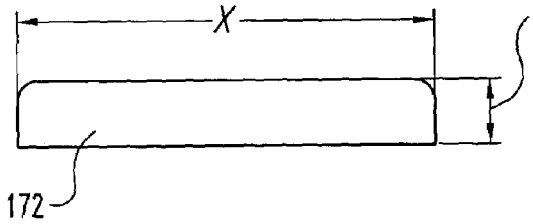
Figure 9C:
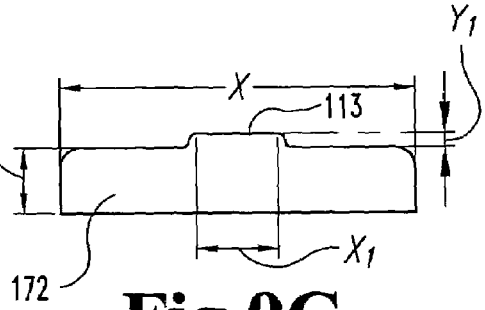
Figure 9D:
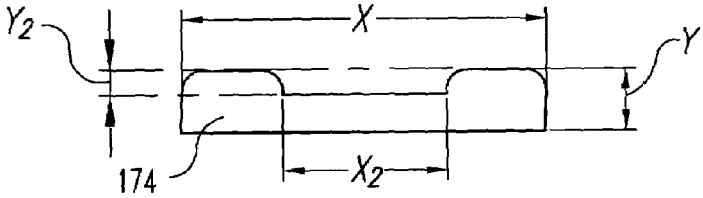

FIG. 9B illustrates one cross-section of hinge portion 172 in an area without a rib. The area is substantially x times y. FIG. 9C illustrates the cross-section of hinge portion 172 in an area with a rib 113. The area is substantially (x times y) plus ($x_1$ times $y_1$). The cross-section in FIG. 9C has a reduced width and thus area corresponding to the area added by the cross-section rib 113. FIG. 9D shows a cross-section of tip portion 174, with a reduced height, which is ground away to form slot 124. The cross-sectional area is substantially (x times y)–($x_2$ times $y_2$). Preferably the inclusion of the rib allows the hinge section to present a narrower front profile and a thicker height while maintaining a constant cross-sectional area.

The rib portion of the limb increases the sectional modulus of the limb, i.e., the limb's spine or stiffness is increased. This also allows thinner limb tips, reducing the amount of mass moved as the limbs recoil from a drawn to brace position. The lower mass in the tips also reduces the moment of inertia, enabling the limbs to react more quickly and at a higher frequency resulting in higher arrow velocity.

Figure 10A:
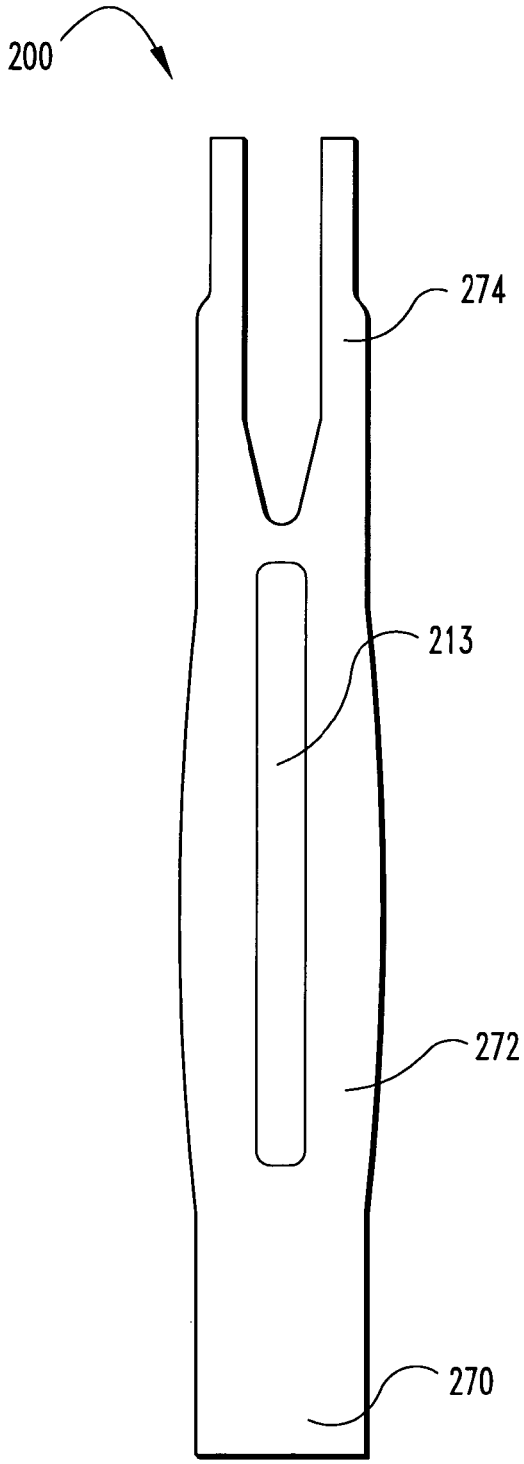
FIGS. 10A and 10B are top and side views of a limb portion according to an alternate preferred embodiment of the present invention.
Figure 10B:
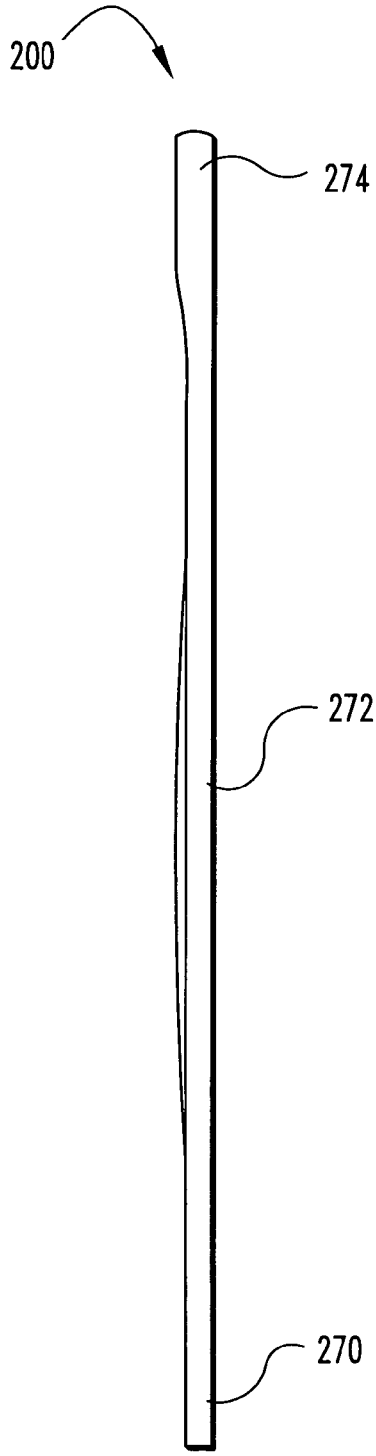

An alternate embodiment of a limb portion is shown in FIGS. 10A and 10B. Limb 200 includes a butt portion 270, a hinge portion 272 and a tip portion 274. A rib portion 213 with a substantially rectangular profile is integral with hinge portion 272.

In an additional alternate embodiment, not shown, an archery bow limb can be formed with two parallel and symmetric limb portions, sometimes called a "quad limb." The limb portions may be separate or connected to each other in one or more places. In a preferred embodiment, each limb portion defines a rib portion.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. An archery bow, comprising:

a. a riser portion with an upper end and a lower end;

b. a pair of bow limb members wherein each bow limb member is formed from fibers and resin, and has a longitudinal length, a butt section, a hinge section and a tip section;

c. wherein the butt section of one bow limb member is attached to said upper and lower ends of said riser respectively;

d. upper and lower rotational members mounted respectively to said tip sections of said upper and lower bow limb members;

e. a bowstring extending between said upper and lower rotational members; and, f. a substantially longitudinal protruding rib portion defined in a face of the hinge section of each bow limb member.

2. The archery bow of claim 1, wherein each bow limb member is formed with a substantially constant glass fiber to resin ratio in said butt section, said hinge section with said rib portion and said tip section.

3. The archery bow of claim 1, wherein each said rib portion has a substantially elliptical profile.

4. The archery bow of claim 1, wherein each said rib portion has a substantially rectangular profile.

5. An archery bow limb, comprising, a longitudinal bow limb member for an archery bow having a length, a butt section attachable to an archery bow riser, a hinge section and a tip section arranged to mount a rotational member, and a protruding rib portion wherein said rib portion protrudes from the front face of said limb.

6. The bow limb of claim 5, wherein said rib portion is defined in said hinge section.

7. The bow limb of claim 6, wherein said rib portion is substantially longitudinal.

8. The bow limb of claim 7, wherein said rib portion is integrally formed with said limb.

9. The bow limb of claim 8, wherein said rib portion has a substantially elliptical profile.

10. The bow limb of claim 8, wherein said rib portion has a substantially rectangular profile.

11. The bow limb of claim 5, wherein said rib portion has tapered edges from the rib portion into said limb.

12. The bow limb of claim 11, wherein said rib portion is convex outward from said limb.

13. The bow limb of claim 12, wherein said rib portion has a middle apex area.

14. The bow limb of claim 5, wherein said limb defines front corner edges radiused along their length.

15. An archery bow limb, comprising, a bow limb member for an archery bow, having a longitudinal length, a butt section attachable to an archery bow riser, a hinge section and a tip section for supporting a rotational member; a protruding rib portion defined in said hinge section; and wherein said bow limb member is formed with a substantially constant cross-sectional area in said butt section, said hinge section and said tip section.

16. The archery bow limb of claim 15, wherein said tip section is formed with a partial height area defining an area to be ground to form tip portions for supporting the axle of a rotational member.

17. The archery bow limb of claim 15, wherein said bow limb is formed from glass fibers and resin.

18. The bow limb of claim 17, wherein said rib portion is substantially longitudinal.

19. The bow limb of claim 18, wherein said rib portion has tapered edges from the rib portion into said limb.

20. The bow limb of claim 19, wherein said rib portion has a substantially elliptical profile.

21. The bow limb of claim 19, wherein said rib portion has a substantially rectangular profile.

22. The bow limb of claim 18, wherein said rib portion increases the sectional modulus of said hinge portion of said limb.

* * * * *